US006068701A

United States Patent [19]

Kohler et al.

[11] Patent Number: 6,068,701

[45] Date of Patent: May 30, 2000

[54] METHOD AND APPARATUS FOR PRODUCING CORRUGATED CARDBOARD

[75] Inventors: Herbert B. Kohler, Uniontown; Sivaram A. Krishnayya, North Canton, both of Ohio

[73] Assignee: Kohler Coating Machinery Corporation, Greentown, Ohio

[21] Appl. No.: 09/027,659

[22] Filed: Feb. 23, 1998

[51] Int. Cl.[7] ..... B05C 1/00

[52] U.S. Cl. ..... 118/249; 118/261; 118/262; 118/119; 118/126; 156/578; 156/472; 156/462

[58] Field of Search ..... 118/249, 253, 118/261, 262, 118, 119, 123, 126; 156/578, 472, 462

[56] References Cited

U.S. PATENT DOCUMENTS

| | | | |
|---|---|---|---|
| 4,338,154 | 7/1982 | Berthelot et al. | 156/462 |
| 4,344,379 | 8/1982 | Roberts | 118/261 |
| 5,275,657 | 1/1994 | Duffy et al. | 118/224 |

FOREIGN PATENT DOCUMENTS 0037332 10/1981 European Pat. Off. .

*Primary Examiner*—Laura Edwards
*Attorney, Agent, or Firm*—Pearne, Gordon, McCoy & Granger LLP

[57] ABSTRACT

A method and apparatus for applying adhesive to the flutes of corrugated board to bond a face thereto. An applicator roll is provided with a uniform thin coating of adhesive by a flexible bar urged toward the surface of the applicator roll. A rider roll is provided adjacent the applicator roll and at the same height to form a vertical space for passage of the board therebetween so that the amount of glue applied to the tip of the flutes is directly proportional to the speed of the applicator roll. The space between the applicator roll and the rider roll is precisely controlled to minimize the amount of crush or deformation of the flutes during the application of the adhesive thereto. The dwell time in which the flutes are in contact with the adhesive layer on the applicator roll is reduced by minimizing the size of the rider roll and wrapping the face substantially around the rider roll. The applicator roll is driven at a speed substantially less than the speed of the rider roll to reduce the amount of adhesive applied to the tip of the flutes. Therefore, the speed of the applicator roll can be automatically adjusted to control the amount of adhesive applied to the tip of the flutes.

22 Claims, 5 Drawing Sheets

METHOD AND APPARATUS FOR PRODUCING CORRUGATED CARDBOARD

BACKGROUND OF THE INVENTION

The present invention generally relates to the production of corrugated cardboard, and more particularly, to a novel and improved method and apparatus for accurately applying an adhesive to the flutes of corrugated board so that the flutes can be bonded to a face.

Typically, corrugated cardboard is formed by producing a corrugated sheet which is initially bonded along one side to a single face. Adhesive is then applied to the crests of the flutes remote from the single face by an applicator roll of a glue machine. Thereafter, a second face is applied to the adhesive on the flutes to produce a composite structure in which corrugations extend between and are bonded to spaced-apart faces.

In some instances, multiple-layer cardboard is produced in which more than one corrugated sheet is adhesively attached to additional faces so that, for example, a central flat face is bonded to a corrugated sheet on each side thereof, and outer flat faces are bonded to the sides of the two corrugated sheets remote from the central face.

The corrugated sheet is typically passed between a rider roll and an applicator roll to apply the adhesive to the flutes. The rider roll typically applies sufficient downward pressure to force the flute tips into contact with the applicator roll. This downward pressure causes compression or deformation of the flutes. The flutes enter the adhesive layer prior to being crushed against the applicator and often become overly wetted or saturated with adhesive due to the long dwell time. As a result, the flutes do not return to their original shape after being crushed. This permanent deformation of the flutes reduces the strength of the final cardboard.

The adhesive applied to the flutes is unsymmetrical because the flutes plow through the adhesive layer on the applicator and are wetted on one side more than the other. This unsymmetrical application of the adhesive results in a lower bond strength for a given weight of adhesive and an rough surface finish on the face sheet due to warpage after the adhesive cures. Additionally, a relatively large amount of over spray is created which further increases the amount of glue used by the process.

Accordingly, there is a need in the art for an improved method and apparatus for producing corrugated cardboard which obtains maximum strength in the finished product and an improved surface finish on the face. Furthermore, it is desirable to apply substantially less adhesive per unit area of the finished product and to produce the improved cardboard at an increased rate of production.

BRIEF SUMMARY OF THE INVENTION

The present invention provides a method and apparatus for uniformly applying adhesive to the tip of the flutes of corrugated sheets which overcomes at least some of the above-noted problems of the related art. In accordance with the present invention, higher line speeds can be achieved, tighter performance specifications exceeding the capability of the industries standard machines are possible, and a significant reduction in the amount of glue used are achieved. It is possible to reduce the adhesive weight deposition rate about ten to forty percent of that required in conventional machines while delivering the same bond and crush strength. Additionally, since there is no practical lower limit to the controlled glue weight, cold set adhesives can be used to further improve board properties and reduce energy costs and warpage losses. Furthermore, in accordance with the present invention, smoother and more printable boards with greatly reduced warpage and improved surface finish are produced.

According to one aspect of the present invention, the apparatus includes an applicator roll rotatable about a generally horizontal axis of rotation, means for applying a substantially uniform coating of adhesive to said applicator roll, and a rider roll rotatable about a generally horizontal axis of rotation and located adjacent the applicator roll. The rotational axis of the rider roll located at substantially the same height as the rotational axis of the applicator roll to form a vertical space for passage of the paper board therebetween.

According to another aspect of the present invention, the method includes the steps of rotating the applicator roll on a rotational axis and rotating a rider roll on a rotational axis located at a height substantially equal to a height of the rotational axis of the applicator roll. The paper board is moved through a vertical space between the applicator roll and the rider roll engaging the crests with the adhesive layer on the applicator roll to apply adhesive to the crests.

According to yet another aspect of the present invention, the method includes the steps of creating a layer of adhesive on the applicator roll, and moving the paper board through a space between the applicator roll and the rider roll for engaging the flutes with the adhesive layer on the applicator roll to apply adhesive to the flutes. The rider roll is rotated at a first speed and the applicator roll is rotated at second speed, wherein the second speed is substantially less than the first speed.

According to another aspect of the present invention, the method includes the steps of rotating an applicator roll, creating a layer of adhesive on the applicator roll, and moving the paper board through a space between the applicator roll and a rider roll for engaging the crests with the layer adhesive on the applicator roll to apply adhesive to the crests. The speed of the applicator roll is controlled to adjust the amount of adhesive applied to the flutes.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
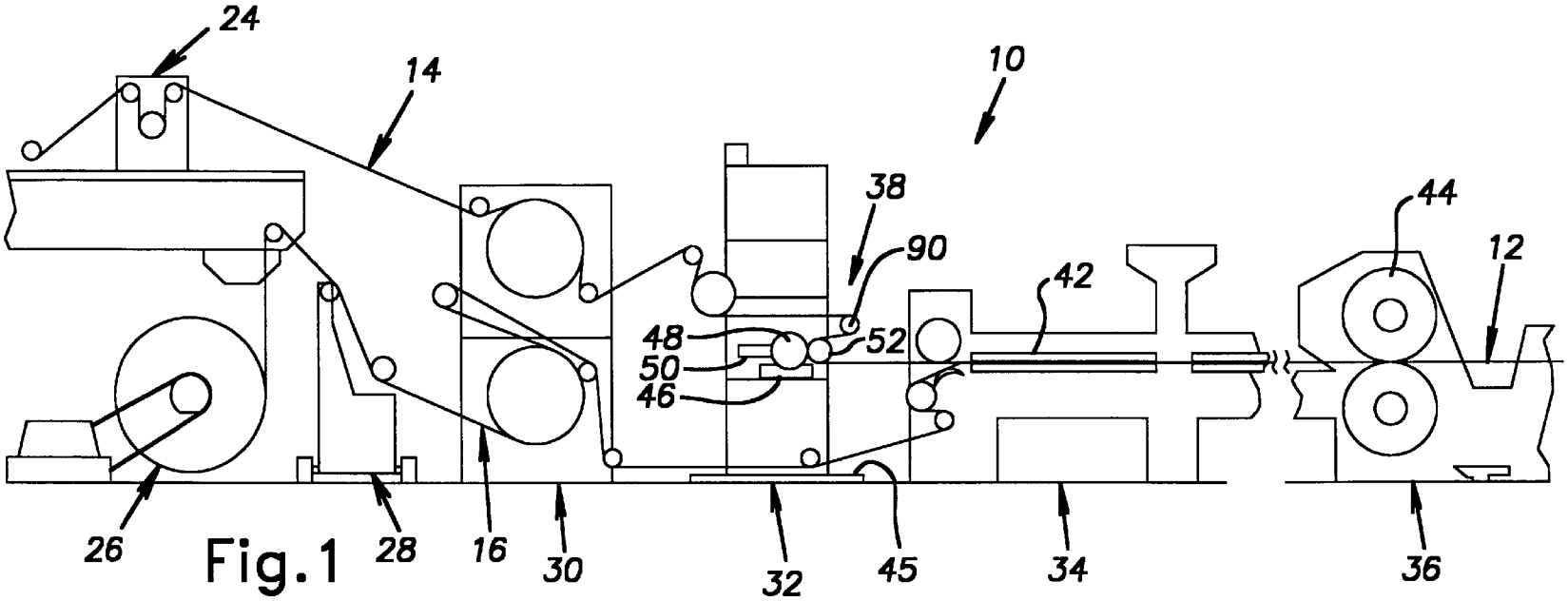
FIG. 1 is a schematic elevational view of a machine for producing cardboard in accordance with the present invention.
Figure 2C:
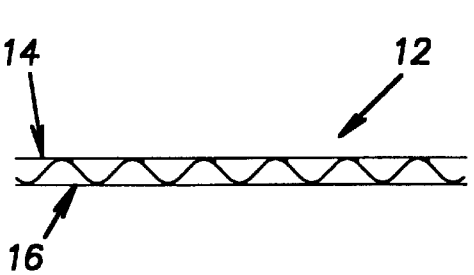
FIG. 2C is an elevational view of the single face corrugated sheet of FIG. 2A with a second face secured thereto.
Figure 2B:
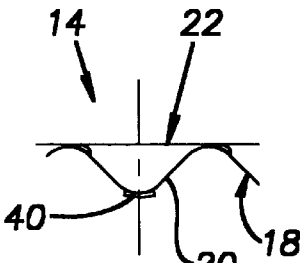
FIG. 2B is an enlarged elevational view of the single face corrugated sheet of FIG. 2A with adhesive applied to the flutes.
Figure 2A:
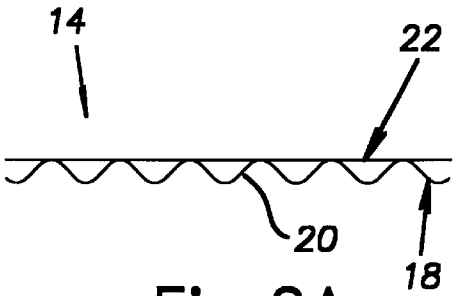
FIG. 2A is an enlarged elevation view of a single face corrugated sheet.

FIG. 1 schematically illustrates a machine 10 according to the present invention for producing single-corrugated cardboard sheet 12. As best shown in FIGS. 2A, 2B, and 2C, the single-corrugated cardboard sheet 12 is produced by joining a web of single-face corrugation assembly 14 with a web of face sheet 16. The single-face corrugation assembly 14 includes a corrugated sheet having a plurality of flutes 20 and a first face sheet 22 bonded to the crests or tips of the flutes 20 on a first side of the corrugated sheet 18. The crests or tips of the flutes 20 on the second side of the corrugated sheet 18, remote from the attached first face sheet 22, are exposed.

It should be understood that the illustrated machine 10 is shown only by way of example and that the present invention can be applied to many different types of machines. For example, the present invention can be easily utilized with machines for producing double-corrugated cardboard or triple corrugated cardboard.

The machine 10 includes a source 24 of the single-face corrugation assembly 14, a source 26 of the second face sheet 16, a coating station 28 for the second face sheet 16, a pre-heating station 30 for heating the corrugation assembly 14 and the second face sheet 16, a gluing station 32 for applying glue to the corrugation assembly 14, a curing station 34 for joining the corrugation assembly 14 and the second face sheet 16, and a traction station 36 for pulling the card board sheet 12 through the machine 10.

The web of the single-face corrugation assembly 14 is supplied to the machine 10 from a source 24 such as, for example, a single facing machine. The source 24 of the corrugation assembly 14 can be of any conventional type. The second face sheet 16 is supplied from a source 26 such as, for example, a supply roll.

From the source 26, the second face sheet 16 passes to the coating station 28. The coating station 28 includes a coating machine for applying a coating to one side of the second face sheet 16. The coating station 28 is not essential to the present invention and is merely illustrated as one available processing apparatus which may be incorporated into the total machine 10, in accordance with the present invention, particularly where at least one side of the cardboard sheet 12 is to be provided with printing and/or a decorative finish.

Next, the corrugation assembly 14 and the second face sheet 22 both pass through the pre-heating station 30. The pre-heating station 30 includes a heating machine for preheating the corrugation assembly 14 and the second face sheet 22. The pre-heating station 30 may or may not be needed depending upon the type of adhesive being applied to the corrugation assembly 14 to join the second face sheet 16.

From the pre-heating station 30, the single-face corrugation assembly 14 passes to the gluing station 32. The gluing station 32 includes a precision glue machine 38 in accordance with the present invention. The glue machine 38 applies an accurately controlled amount of adhesive 40 (best shown in FIG. 2B) to the tips of the flutes 20 as described in more detail hereinafter.

Next, the corrugation assembly 14 and the second face sheet 22 both pass through the curing station 34. The curing station 34 includes a "double facer" which brings the single-face corrugation assembly 14 and the second face sheet 16 are brought together. The double facer can be of any conventional type. Once brought together, the single-face corrugation assembly 14 and the second face sheet 16 pass between guide plates 42 which maintain the assembly flat and straight as the adhesive 40 cures. Additionally, heat can be applied to the plate to aid in the curing of the adhesive.

From the curing station 34, the glued and dried cardboard sheet 12, including the two face sheets 16, 22 bonded to opposite sides of the corrugated sheet 18, passes to the traction station 36. The traction station 36 includes drive and traction rollers 44 which pull the cardboard sheet 12 from the machine 10.

The glue machine 38 is mounted on linear rails 45 so that the machine is movable toward and away from the double facer 34. The glue machine 38 is moved toward the double facer to minimize the web path length between the glue machine 38 and the double facer 34 to reduce the amount of glue and scrap associated with line starts and stops. However, the glue machine can be easily moved away from double facer 34 to provide access for webbing and maintenance of the glue machine 38.

Figure 3:
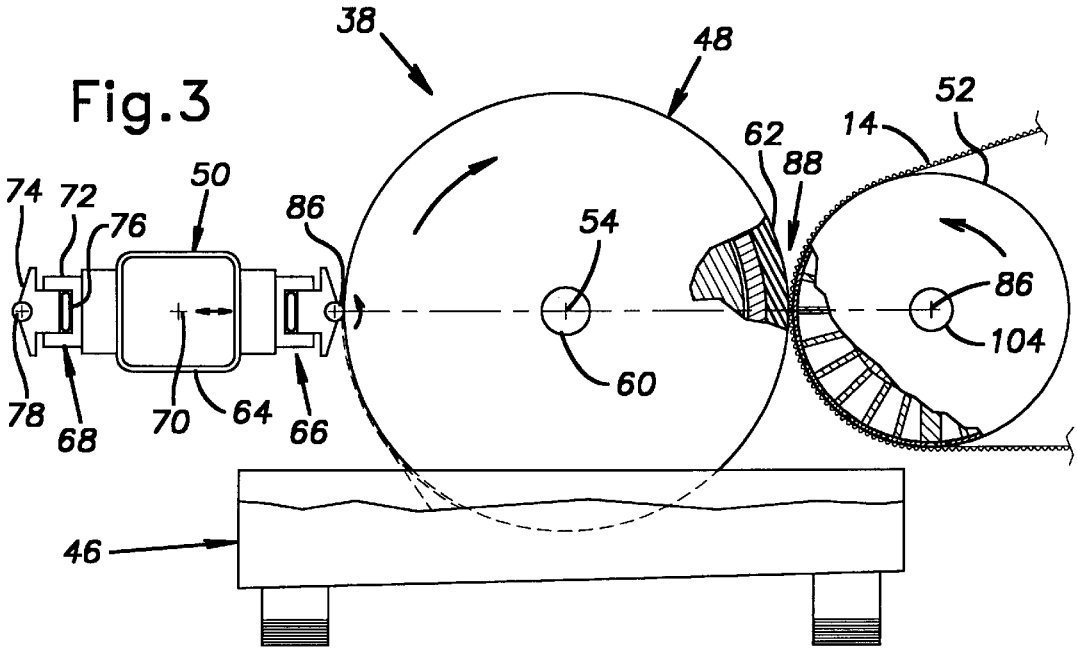
FIG. 3 is an enlarged fragmentary view, partially in cross-section, showing a portion of the machine of FIG. 1 at a glue mechanism for applying adhesive to crests of a single faced corrugation assembly.

As best shown in FIG. 3, the glue machine 38 includes a glue tray 46, a glue applicator roll 48, an isobar assembly 50, and a rider roll 52. The glue tray 46 is a container having an open top which when filled with glue provides a source or supply of adhesive. The glue tray 46 is located directly below the applicator roll 48 and extends below at least a portion of each the isobar assembly 50 and the rider roll 52.

The applicator roll 48 is journaled for rotation about a horizontal and transverse rotational axis 54 in the direction indicated by the arrow (clockwise as viewed in FIG. 3). The applicator roll 48 is located above the glue tray 46 and positioned so the lower portion of the applicator roll 48 is emersed in the adhesive within the glue tray 46. As the applicator roll 48 rotates, a coating of adhesive is applied to the periphery of the applicator roll 48. As the surface of the applicator roll 48 emerges from the adhesive within the glue tray 46, a coating of adhesive exceeding the required final coating thickness adheres to the outer peripheral surface of the roll 48.

Figure 4:
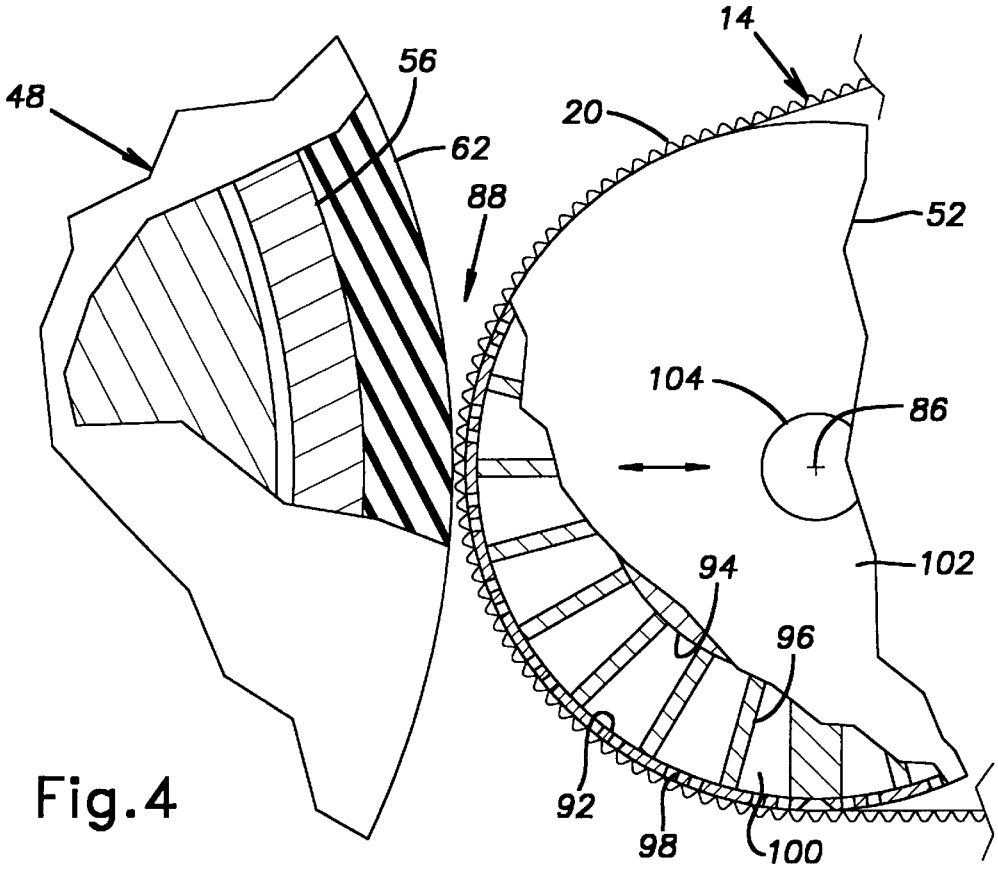
FIG. 4 is an enlarged fragmentary view, partially in cross-section, showing a portion of the glue mechanism of FIG. 3 at an interface between an applicator roll and a vacuum rider roll.
Figure 5:
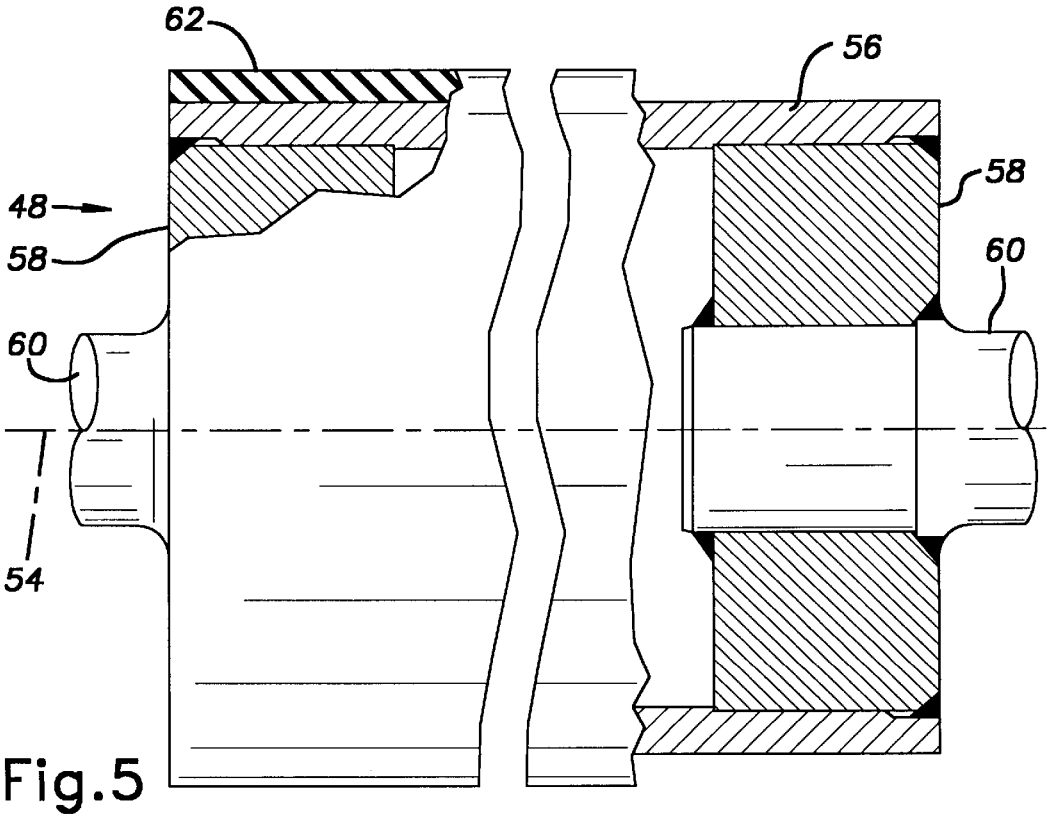
FIG. 5 is a fragmentary side view, partially in cross-section, of the applicator roll of FIGS. 3 and 4.

As best shown in FIGS. 4 and 5, the applicator roll 48 preferably has an outer shell 56, a pair of end plates 58, and a pair of support shafts 60. The outer shell 56 is cylindrically-shaped and formed from a suitable metal. The end plates 58 are secured to opposite ends of the shell 56 in any suitable manner such as, for example welding. The support shafts 60 are secured to the end plates 58 at the rotational axis 54 so that the end plates 58 connect the support shafts 60 to the outer shell 56. The shafts 60 are secured to the end plates 58 in any suitable manner such as, for example welding. A coating 62 is applied to the outer peripheral surface of the cylindrical shell 56 and provides a smooth peripheral contact surface of the applicator roll 48. The coating 62 is of any suitable material such as, for example rubber and preferably has a hardness in the range of 0 to 5 P & J hardness. The coating is preferably provided with an extremely smooth surface finish.

The isobar assembly 50 is mounted adjacent to the periphery of the applicator roll 48 and functions to remove excess adhesive from the outer peripheral surface of the applicator roll 48 so that a precise uniform thickness of adhesive coats the outer peripheral surface of the applicator roll 48 after it has rotated past the isobar assembly 50. Preferably, the isobar assembly 50 is located at the rear side of the applicator roll 48 and at the same height as the rotational axis 54 of the applicator roll 48, that is, the isobar assembly 50 is located at "a 9 o'clock position" (as best shown in FIG. 3).

The illustrated embodiment of the isobar assembly 50 includes a frame member 64 and first and second metering rod assemblies 66, 68. The frame member 64 is relatively stiff and is mounted on the glue machine 38 for rotation about a central axis 70 over at least 180°. Therefore, the frame member 64 can be rotated from the position illustrated to a position of opposite orientation. The metering rod assemblies 66, 68 are mounted on opposite sides of the frame member with the first assembly on the side facing the applicator roll 48 and the second assembly on the side facing away from the applicator roll 48. It can be seen that when the frame member 64 is rotated 180 degrees, the position of the assemblies 66, 68 is reversed, that is, with the second assembly 68 on the side facing the applicator roll 48 and the first assembly 66 on the side facing away from the applicator roll 48.

In instances where it is necessary to use two different types of adhesives which require different isobar structures, the first and second assemblies 66, 68 are each selected to be suitable with one of the two adhesives. When the adhesive is changed, requiring the different isobar structure, the isobar assembly 50 is rotated 180° to position the second assembly 68 in the active position.

In instances where it is not necessary to change adhesives, the first and second assemblies 66, 68 can be the same so that the second assembly 68 is a spare. In the event that the first assembly 66 wears or becomes unsatisfactory for any reason, the isobar assembly 50 is rotated 180 degrees so that the second assembly 68 is pivoted into the operative position without delay.

The metering rod assemblies 66, 68 are substantially identical in structure, and each includes a channel member 72, a plastic holder 74, a tubular pressure-tight bladder 76, and a isobar or metering rod 78. The channel member 72 is secured to the side of the frame member 64 and forms a longitudinally extending channel. The holder 74 has a projection on an inner side and a groove on an outer side. The projection is sized and shaped to extend into the channel so that the holder 74 is moveable toward and away from the frame member 64 within the channel member 72. The groove is sized and shaped for receiving the metering rod 78 so that the metering rod 78 is mounted in and supported by the holder 74.

The bladder 76 is positioned between the holder 74 and the channel member 72 within the channel of the channel member 72. Fluid pressure, preferably air pressure, is applied to the bladder 76 of the active metering rod assembly 66 which is the assembly 66, 68 facing the applicator roll 48. The fluid pressure produces a force urging the holder 74 and the attached metering rod 78 toward the outer peripheral surface of the applicator roll 48. It should be noted that the force produced by the bladder 76 is uniform along the entire length of the metering rod 78.

It is important for the metering rod 78 to be supported such that the lengthwise center of the metering rod 78 does not deflect away from the outer peripheral surface of the applicator roll due to hydraulic pressure which tends to cause separation between the metering rod 78 and the outer peripheral surface of the applicator roll 48. Hydraulic pressure is a direct function of speed and adhesive viscosity, among other things. The metering rod 78 and the plastic holder 74 are sized such that they are flexible under the hydraulic forces encountered. Because the pressure supplied from the bladder 76 establishes a uniform force along the entire length of the metering rod, however, there is no change in spacing between the outer peripheral surface of the applicator roll 48 and the metering rod 78 along its entire length. Therefore, the metering rod 78 is positioned to produce a uniform thickness or coating of adhesive on the outer peripheral surface of the applicator roll 48 along its entire length. This is true even if the frame member 64 deflects to some degree under the loading conditions.

Figure 6:
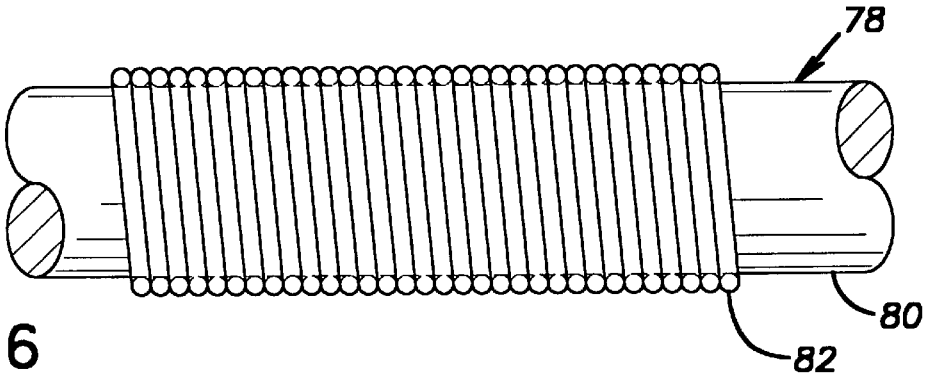
FIG. 6 is an enlarged fragmentary side view of an isobar metering device of the glue mechanism of FIG. 2.
Figure 6A:
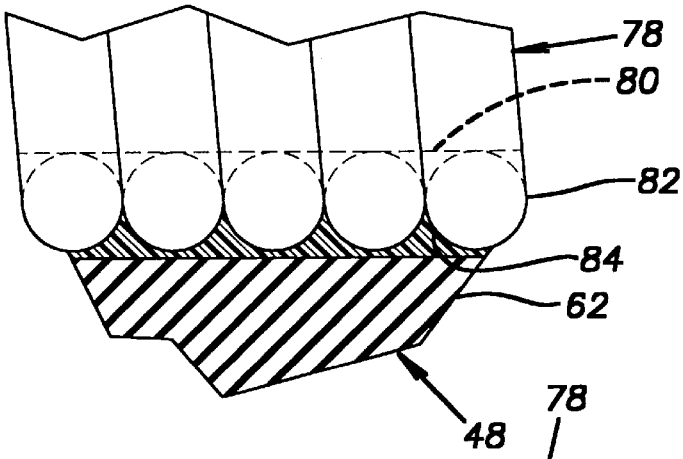
FIG. 6A is an enlarged fragmentary view at an interface between the isobar metering device and the applicator roll.

As best shown in FIGS. 6 and 6A, the isobar or metering rod 78 preferably includes a cylindrical rod 80 and spiral wound wire 82 thereon. The rod 80 extends the length of the applicator roll 48 and has a uniform diameter such as, for example about ⅝ of an inch. The wire 82 has a relatively small diameter such as, for example, of about 0.060 inches. The wire 82 is tightly spiral wound around the rod 80 in abutting contact along the length of the rod 80 to provide an outer surface, best illustrated in FIG. 6A, which forms small concave symmetrical cavities between the contact points of adjacent loops of wire 82. These small concave cavities 84 provide spaces with respect to the smooth outer surface of the applicator roll 48 so that small ridges of adhesive remain on the surface of the applicator roll 48 as the surface passes the metering rod 78.

It should be noted that even though adhesive on the peripheral outer surface of the applicator roll 48 tends to be in the form of ridges after it passes the metering rod 78, the cohesion of the adhesive material tends to cause it to flow laterally and assume a flat, thin coating structure. Of course, the viscosity of the adhesive in relation to the cohesion thereof determines the extent to which the adhesive coating becomes completely smooth.

The position of the isobar assembly 50 is adjustable toward and away from the applicator roll 48 to precisely set the gap therebetween (as indicated in FIG. 3). When the isobar assembly 50 is adjusted so that metering rod 78 is in virtual contact with the outer peripheral surface of the applicator roll 48, essentially all of the adhesive except the adhesive passing through the concave cavities, is removed from the peripheral outer surface of the applicator roll 48. On the other hand, when the metering rod 78 is spaced slightly away from the outer peripheral surface of the applicator roll 48 by reducing the pressure within the associated bladder 76, a coating of adhesive having greater thickness remains on the outer peripheral surface of the applicator roll 48.

As best shown in FIG. 3, the metering rod 78 is mounted in and supported by the holder for rotation therein about a central axis 86. In operation, the metering rod 78 is rotated at a relatively high speed in the same direction as the rotation of the applicator roll 48 so that the metering rod 78 remains clean by throwing off any excess adhesive. By rotating in the same direction as the applicator roll 48, excess adhesive is thrown in a downward direction back into the glue tray 46.

Figure 7:
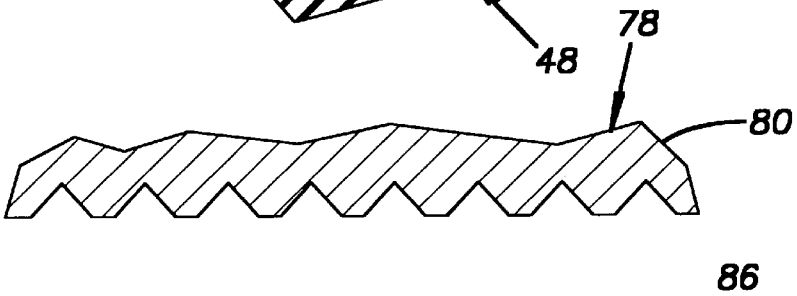
FIG. 7 is an enlarged fragmentary side view, similar to FIG. 6, of an alternative isobar metering device which may be used with the glue mechanism of FIG. 3

As best shown in FIG. 7, the cylindrical rod can alternatively be machined to provide a spiral, thread-like outer surface rather than having the wire wound thereon, The machined outer surface preferably has inwardly extending cavities 86 which function similarly to the concave cavities 84 formed by the wire 82. The illustrated cavities 86 are axially spaced a slight distance along the length of the metering rod 78 to provide a narrow flat section between the cavities 86. This variation of the metering rod 78 tends to remove a greater amount of adhesive and is typically used in applications where very thin coatings are required. Here again, the rod 78 is rotated to keep it from accumulating excess adhesive.

As best shown in FIG. 3, the rider roll 52 is journaled for rotation about a horizontal and transverse axis 88 in the direction opposite that of the applicator roll 48 and indicated by the arrow (counterclockwise as viewed in FIG. 3). Preferably, the rider roll 52 is located at the forward or downstream side of the applicator roll 48 and with the axis 86 at the same height as the axis 54 of applicator roll 48, that is, the rider roll 52 is located at "a 3 o'clock position" (as best shown in FIG. 3). Located in this position the metering rod 86, the applicator roll 48, and the rider roll 52 are positioned linearly, that is, the centerlines 86, 54, 86 of the metering rod 78, the applicator roll 48, and the rider roll 52 are substantially in the same plane and located at the same height (best shown in FIG. 3). Additionally, a vertically extending gap or space 88 is formed between the applicator roll 48 and the rider roll 52 for passage of the corrugation assembly 14 therethrough.

As best shown in FIG. 4, the position of the rider roll 52 is adjustable directly toward and away from the applicator roll 48 so that the size of the gap can be precisely adjusted to control the degree to which the flutes 20 of the corrugation assembly 14 are crushed as they pass therethrough. The degree of crush can be controlled to a high degree of accuracy because the rider roll 52 is linearly adjustable, that is, the rotational axis 86 of the rider roll 52 is movable directly toward and away from the rotational axis 54 of the applicator roll 48. Additionally, flexure of the rolls 48, 58 due to gravity does not affect the gap 88 because the gap 88 is vertical.

The gap is precisely closed and opened by a closed loop system including a motor and a linear transducer which moves the rider roll 52 toward and away from the applicator roll 48. Preferably, a pair of air cylinders can also open the gap between the rider roll 52 and the applicator roll 48 to a relatively large distance, such as about 4 inches, to meet various safety requirements.

Side to side accuracy of the precise gap, that is along the length of the rider roll 52, is maintained with two adjustment jacks and a cross-connecting shaft. The shaft transversely extends the length of the rider roll 52 and the adjustment jacks are located at or near the ends of the shaft so that the rider roll outer surface can be adjusted to be precisely parallel to the applicator roll outer surface. The cross-connecting shaft of the illustrated embodiment is a central shaft 89 of an idler roll 90 (best shown in FIG. 10) discussed in more detail hereinbelow. It is noted, however, that the cross-connecting shaft could alternately be a central shaft in the rider roll 52.

Figure 8:
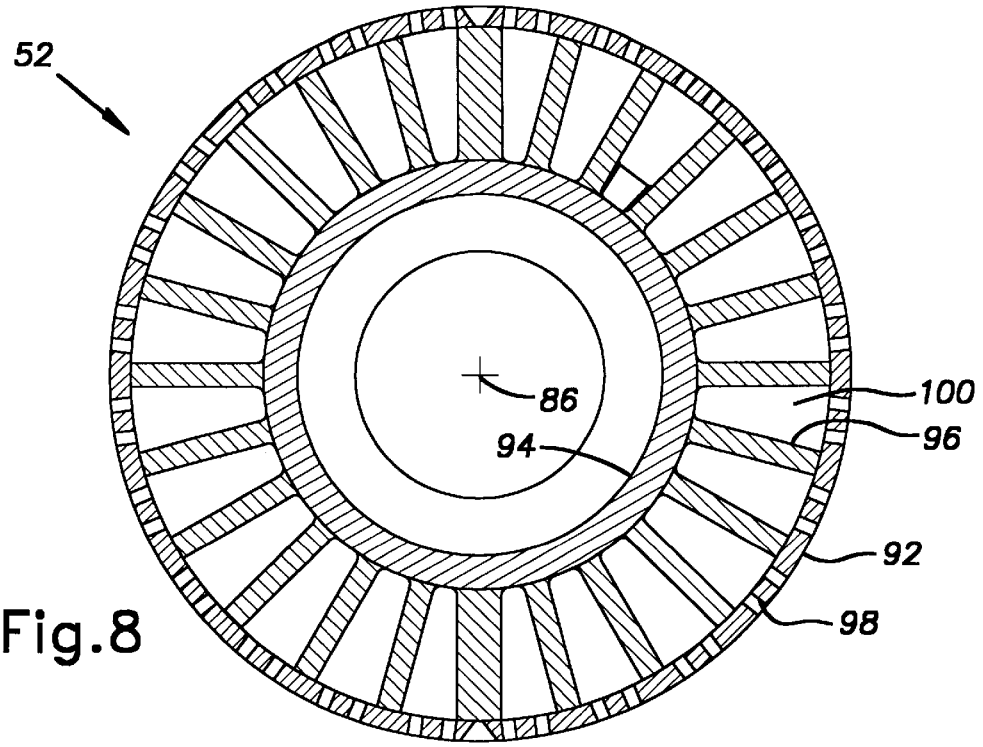
FIG. 8 is a cross-sectional end view of the vacuum rider roll of FIGS. 3 and 4.

As best shown in FIGS. 4 and 8, the rider roll 52 of the illustrated embodiment is a vacuum roll which includes an outer wall 92, an inner wall 94, and a plurality of dividing walls 96 extending between the outer and inner walls 92, 94. The outer wall 92 is generally cylindrically-shaped and has a plurality of rows of small diameter openings 98 formed at intervals along the length thereof. The inner wall 94 is generally cylindrical shaped and is imperforate. The inner wall 94 has a diameter smaller than the outer wall 92 so that a space if formed therebetween. The dividing walls 96 radially and axially extend between the inner and outer walls 92, 94 to divide the space therebetween into separate axially extending chambers 100. The rows of openings 98 in the outer wall 92 communicate with an associated one of the chambers 100. End plates 102 form plenums (not illustrated) at the ends of the rider roll 52 which communicate the chambers 100. Shafts 104 are provided on the end walls 102 at the central axis 84.

The size of the rider roll 52 is preferably minimized to as small as practically possible. The minimized size of the rider roll 52 reduces the number of the flutes 20 of the corrugation assembly 14 which are in contact with the adhesive layer and thus reduces the dwell time in which the flutes 20 are in contact with the adhesive layer as discussed hereinbelow in more detail.

Figure 9:
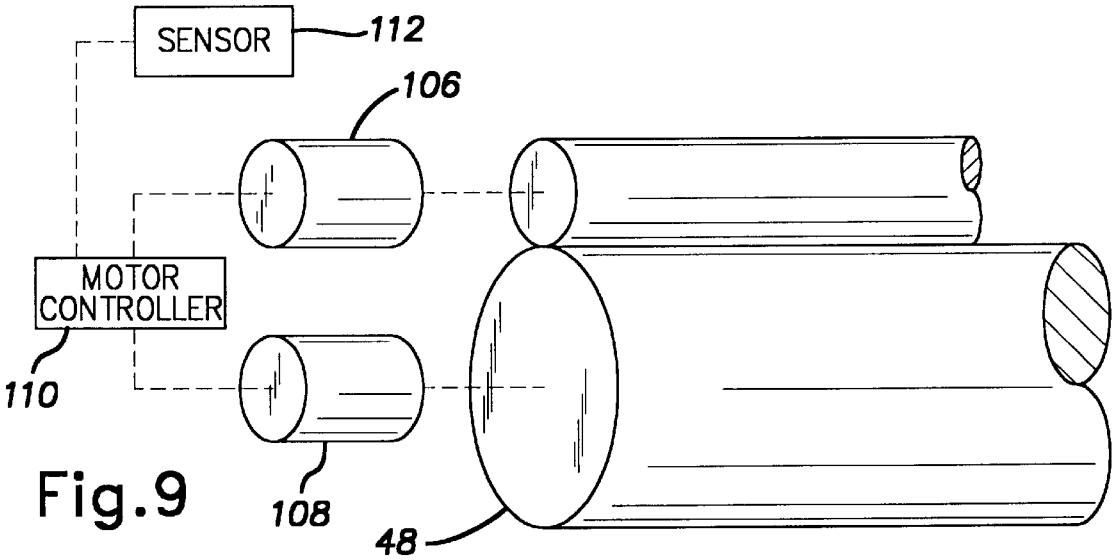
FIG. 9 is a schematic view of a drive system for driving the applicator roll and the vacuum rider roll and for controlling the relative speeds thereof.

FIG. 9 schematically illustrates a drive system for the applicator roll 48 and the vacuum rider roll 52. A first variable speed electric motor 106 is connected to the vacuum rider roll 52 and provides power to rotate the rider roll 52 during the operation of the machine 10. A second variable speed motor 108 is connected to the applicator roll 48 and provides power to rotate the applicator roll 48 during the operation of the machine 10. An electronic control 110 is connected to both of the motors 106, 108 and adjustably controls the rotational speed of the applicator roll 48 relative to the rotational speed of the vacuum rider roll 52. This ability to control the relative speeds of the two rolls 48, 52 is an important feature of the present invention because it allows very precise control of the transfer of adhesive from the applicator roll 48 to the flutes 20 of the corrugation assembly 14.

Because the space 88 between the applicator roll 48 and the rider roll 52 is vertical, gravity pulls straight down on the glue layer at the nip point of the space 88 so that the amount of glue applied is directly proportional to the rotational speed of the applicator roll 48. Therefore, changes in glue layer thickness on the applicator roll 48 are no longer necessary for controlling the amount of glue applied to the corrugation assembly 14 or coating weight control. The coating weight can be automatically controlled by connecting a glue weight sensor 112 to the motor controller 110 so that the controller 110 automatically adjusts the speed of the applicator roll 48 until the weight detected by the sensor 112 is equal to a desired amount.

It is noted that as the speed of the applicator roller 48 is reduced relative to the rider roll 52, the amount of glue applied to the corrugation assembly 14 is reduced. Preferably, the speed of the applicator roll 48 is adjusted by the controller 110 to be slower than the speed of the rider roll 52 and therefore, the flutes 20 of the corrugation assembly 14. The rotational speed of the applicator roll 48 is preferably about 90% or less of the rotational speed of the rider roll 52 (that is, less than the line speed of the corrugation assembly 14), more preferably about 80% or less of the rotational speed of the rider roll 52, even more preferably about 40% or less of the rotational speed of the rider roll 52, and most preferably about 30% or less of the rotational speed of the rider roll 52. The large difference in speed enables the flutes 20 to receive a more controlled and smaller amount of adhesive and enables the flutes 20 to remove virtually all of the adhesive from the applicator roll 48 to reduce over spray.

Figure 10:
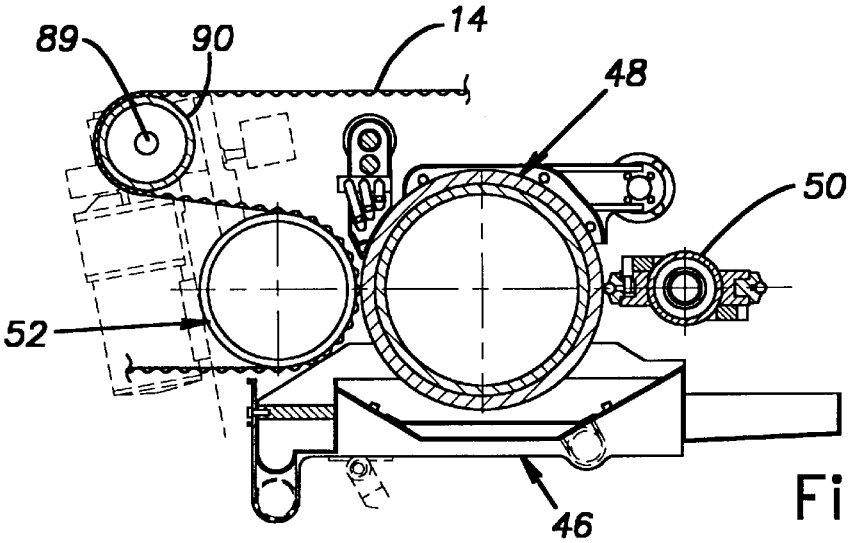
FIG. 10 is an fragmentary elevational view, partially in cross-section, similar to FIG. 2 but viewed form the opposite side and showing additional features of a rider system of the glue mechanism.

As best shown in FIG. 10, the idler roll 90 is arranged so that the corrugation assembly 14 is substantially wrapped around the rider roll 52. Particularly, in the area of the space 88 between the applicator roll 48 and the rider roll 52. Such an arrangement reduces the number of flutes 20 in contact with the adhesive layer and thus the dwell time in which the flutes 20 of the corrugation assembly 14 are in contact with the adhesive layer as discussed in more detail hereinbelow. The corrugation assembly 14 preferably wraps around at least 30 percent of the periphery of the rider roll 52, and more preferably wraps around about 50 percent, that is about 180 degrees, of the periphery of the rider roll 52. In the illustrated embodiment, the idler roll 90 is positioned on the forward side of the rider roll 52 so that the corrugation assembly moves in a generally S-shaped pathway around the idler roll 90 and the rider roll 52.

The idler roll 90 is preferably carried by an arm assembly which moves the rider roll 52 to that the idle roll 90 rider roll 52 are rigidly connected together. As a result, the idler roll 90 moves with applicator roll 48 as the applicator roll 48 is moved to adjust the precisely controlled gap 88. Therefore, there is no change in the length of the web path if the gap 88 is changed or the position of the glue machine 38 is moved.

Figure 11:
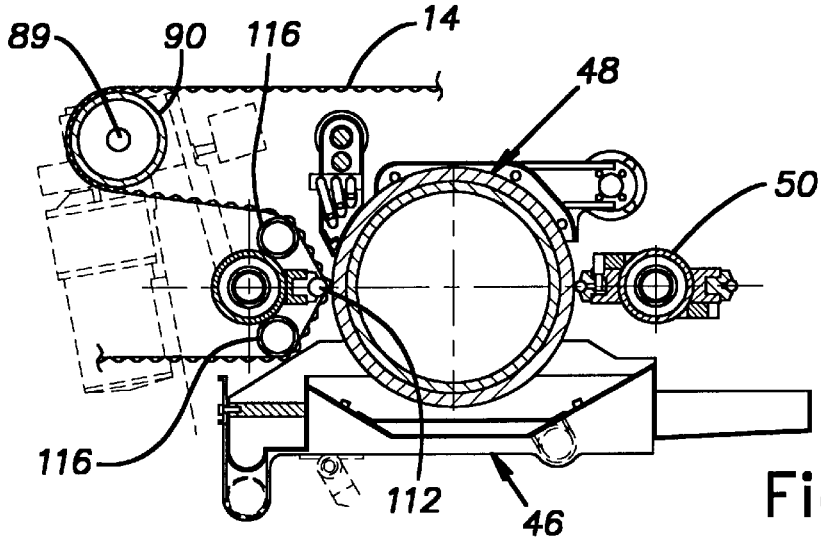
FIG. 11 is an fragmentary elevational view, partially in cross-section, similar to FIG. 10 but showing an alternative embodiment of the rider system.
Figure 12:
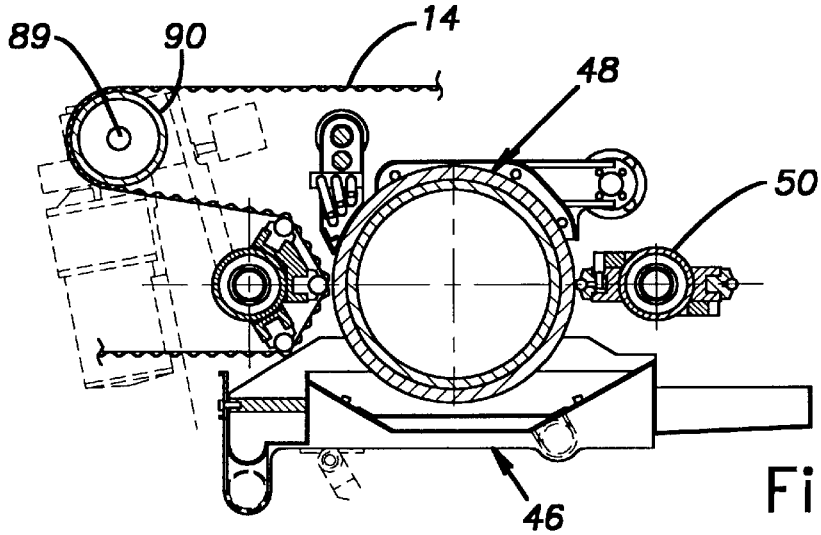
FIG. 12 is an fragmentary elevational view, partially in cross-section, similar to FIGS. 10 and 11 but showing another alternative embodiment of the rider system.

As best shown in FIGS. 11 and 12, alternate embodiments of the rider system can be utilized within the scope of the present invention to even further reduce the number of flutes 20 in contact with the glue layer and thus the dwell time. As shown in FIG. 11, the rider system can be a relatively small diameter rod 112 supported by a rod holder 114. The rod holder 114 can have a structure similar to the metering rod assemblies described hereinabove in detail. The rod 112 is preferably positioned between a pair of idler rolls 116 arranged to direct the corrugation assembly 14 to and from the rod 112. The rod 112 is an extremely small sized rider roll which operates as described in detail hereinabove with regard to the rider roll 52 of the first embodiment. The rod 112, however, provides an extremely small diameter compared to typical rider rolls. The rod 112 can have a diameter of, for example 1.5 inches.

As shown in FIG. 12, the rider system can alternatively include three of the relatively small rods 112 supported by three of the rod holders 114. The two additional rods 112 function as and replace the idler rolls 116 discussed above with regard to the embodiment of FIG. 11.

During operation of the glue machine 10, the applicator roll 48 is rotating and picks-up adhesive from the glue pan 46 onto the smooth peripheral outer surface of the applicator roll 48. As the adhesive rotates past the isobar assembly 50, the metering rod 78 removes excess adhesive from the applicator roll 48 and leaves a precisely controlled extremely thin layer of adhesive on the outer peripheral surface of the applicator roll 48. As the applicator roll 48 continues to rotate, the precisely controlled thickness of adhesive moves from the isobar assembly 50 to the space 88 between the applicator roll 48 and the rider roll 52, that is, the location where it is engaged by the flutes 20 of the corrugation assembly as described in more detail hereinbelow.

The rider roll 52 is rotating in a direction opposite to applicator roll 48 and vacuum is applied to at least the chambers 100 of the rider roll 52 as they are positioned adjacent to the applicator roll 48. Because vacuum is applied along the zone of engagement between the first face sheet 22 of the corrugation assembly 14 and the peripheral surface of the vacuum rider roll 52, the first face sheet 22 smoothly engages the outer surface of the rider roll 52 and is held, to a limited extent, against slippage relative thereto.

As the flutes 20 of the corrugation assembly 14 pass through the nip of the precisely controlled vertical space 88 between the applicator roll 48 and the rider roll 52, the flutes come into contact with the thin coating of adhesive and/or the applicator roll 48. The flutes 20 undergo a characteristic rolling deflection pattern independent of the speed of the applicator roll 48 and the space 88 because of the resiliency of the flutes 20 as discussed in more detail hereinafter. Because the space 88 is precisely controlled, a uniform and symmetric line of adhesive is applied to the tip of the flutes 20 without any substantial deformation or crush of the flutes 20. The position of the rider roll 52 is preferably adjusted so that the amount of crush, that is the reduction in height of the flutes 20, is minimized.

Because the corrugation assembly 14 is substantially wrapped around the rider roll 52 and/or the size of the rider system is minimized, the flutes 20 contact the adhesive layer and/or the applicator roll 52 only when they enter the nip of the space 88 so that they are wetted with adhesive and crushed at essentially the same time. Preferably, only about 1 to about 1½ of the flutes 20 are in contact with the adhesive and/or the applicator roll 52 at any given time. No presoaking or post soaking of the flutes 20 occur, that is, the flutes 20 do not touch the adhesive before reaching the nip of the space 88 or after leaving the nip of the space 88. Therefore the dwell time, the time at which the flutes 20 are in contact with the adhesive and/or the applicator roll 52, is minimized so that the flutes 20 remain resilient. Note that the flutes 20 loose resiliency if they are overly wetted or saturated with the adhesive. The short dwell time and resulting resiliency of the flutes 20 enables the crushed flutes to fully spring back. The full spring back ensures that shape and caliper are fully maintained for maximum strength in the final product.

The dwell time is further reduced by having an extremely thin layer of adhesive on the applicator roll 52 such as that provided by the metering of the isobar assembly 50. An even thinner glue layer can be achieved by using a thicker adhesive, that is, a higher viscosity adhesive such as, for example, a glue with a higher starch to water ratio.

As the flutes 20 pass through the nip of the vertical space 88, the thin coating of adhesive on the applicator roll 52 is transferred to the tips of the flutes 20. In FIG. 4, the thin coating of adhesive is not illustrated because of its very limited thickness. Any spray of adhesive generated at the nip is downwardly directed without a horizontal speed component. Therefore, no adhesive is sprayed outside the glue tray 46, which is located directly below the nip, even at high speeds.

Additionally, gravity eliminates any pooling problems of the adhesive because gravity pulls the adhesive straight down at the nip. As best shown in FIG. 2B, an extremely accurate application of a relatively small amount of adhesive 40 directly onto the apex of the flutes 20. The adhesive has an even thickness and is symmetric about the apex of the flutes 20 with sharply defined edges resulting in both a reduction in the amount of adhesive used and a maximum bonding strength.

The combination of metering a very thin layer of adhesive on the applicator roll 48, maintaining a precise and adjustable vertical gap 88 between the applicator roll 48 and the rider roll 52, and eliminating pre-nip and post-nip soaking of the flutes 20 in the thin layer of adhesive, allows the applicator roll 48 to be rotated at only 30% of the line speed with no discernable snow plow effects. Additionally, the amount of glue consumed is dramatically reduced because of minimized spray and stringing of the adhesive. Furthermore, the glue is precisely positioned on the tip of the flutes so that the final product has a maximum caliper and an extremely smooth outer surface finish.

With the present invention it is possible to efficiently apply virtually any type of hot or cold adhesive and obtain maximum strength in the finished product while applying substantially less adhesive per unit of area of the finished product.

Although particular embodiments of the invention have been described in detail, it will be understood that the invention is not limited correspondingly in scope, but includes all changes and modifications coming within the spirit and terms of the claims appended hereto.

What is claimed is:

1. An apparatus for applying adhesive to the flutes of corrugated paper board, said apparatus comprising:

an applicator roll rotatable about a generally horizontal axis of rotation;

means for applying a substantially uniform coating of adhesive to said applicator roll; and a rider rotatable about a generally horizontal axis of rotation and located adjacent said applicator roll, said rotational axis of said rider located at substantially the same height as said rotational axis of said applicator roll to form a vertical space therebetween for passage of the paper board, said rider having an effective outer diameter smaller than an effective outer diameter of said applicator roll such that the dwell time in which the flutes are in contact with the coating of adhesive on the applicator roll is reduced.

2. The apparatus according to claim 1, wherein said rider is linearly movable toward and away from said applicator roll.

3. The apparatus according to claim 1, wherein said applying means is rotatable about a generally horizontal axis of rotation and located at substantially the same height as said rotational axis of said applicator roll.

4. The apparatus according to claim 1, wherein said applying means is an elongate flexible bar.

5. The apparatus according to claim 1, wherein said rider is a roll.

6. The apparatus according to claim 5, wherein said rider is a vacuum roll.

7. The apparatus according to claim 1, wherein said rider is an elongate flexible bar.

8. The apparatus according to claim 1, further comprising an idler roll rotatable about a horizontal axis of rotation and located to wrap the corrugated paper board around the rider near the vertical space.

9. The apparatus according to claim 8, wherein said idler roll is located to wrap the corrugated paper board around at least 30 percent of an outer periphery of the rider.

10. The apparatus according to claim 8, wherein said idler roll is located to wrap the corrugated paper board around at least 50 percent of an outer periphery of the rider.

11. A glue machine for applying adhesive to the flutes of corrugated paper board to bond such flutes to a face sheet, said apparatus comprising:

a source of adhesive;

an elongate smooth surface applicator roll immersed along its lower portion in said source of adhesive to apply a relatively thick coating of adhesive to said smooth surface, said applicator roll rotatable about a generally horizontal axis of rotation;

an elongate flexible bar positioned adjacent said applicator roll at an applicator roll surface location subsequent to the coating thereof to cause excess coating adhesive to be removed and leaving a coating of adhesive along the entire length of said applicator roll which does not vary between the ends of the applicator roll and locations thereof intermediate its ends; and an elongate vacuum rider roll adjacent to said applicator roll for engaging and vacuum gripping the paperboard, said rider roll rotatable about a generally horizontal axis of rotation, said rotational axis of said rider roll located at substantially the same height as said rotational axis of said applicator roll to form a vertical space therebetween for passage of the paper board therebetween, said vacuum rider roll having an effective outer diameter smaller than an effective outer diameter of said applicator roll such that the dwell time in which the flutes are in contact with the coating of adhesive on the applicator roll is reduced.

12. The glue machine according to claim 11, wherein said rider roll is linearly movable toward and away from said applicator roll.

13. The glue machine according to claim 11, wherein said elongate flexible bar is rotatable about a generally horizontal axis of rotation and located at substantially the same height as said rotational axis of said applicator roll.

14. The glue machine according to claim 11, further comprising an idler roll rotatable about a horizontal axis of rotation and located to wrap the corrugated paper board around the rider roll near the vertical space.

15. The glue machine according to claim 14, wherein said idler roll is located to wrap the corrugated paper board around at least 30 percent of an outer periphery of said rider roll.

16. The glue machine according to claim 14, wherein said idler roll is located to wrap the corrugated paper board around at least 50 percent of an outer periphery of said rider roll.

17. The apparatus according to claim 1, wherein said adhesive applying means and said rider are located on opposite sides of said applicator roll and are each linearly movable toward and away from said applicator roll along a horizontal plane extending through the horizontal axis of rotation of said applicator roll.

18. The apparatus according to claim 7, wherein said bar h as a diameter of 1.5 inches.

19. The apparatus according to claim 7, wherein said rider includes a pair of idler rolls located on opposite sides of said bar to direct the paper board to and from the bar.

20. The apparatus according to claim 7, wherein said rider includes a pair of rods located on opposite sides of said bar to direct the paper board to and from the bar.

21. The apparatus according to claim 8, wherein said idler roll and said rider are rigidly connected together such that the idler roll moves with the rider when adjusting the vertical space.

22. An apparatus for applying adhesive to the flutes of corrugated paper board, said apparatus comprising:

an applicator roll rotatable about a generally horizontal axis of rotation;

means for applying a substantially uniform coating of adhesive to said applicator roll; and a rider rotatable about a generally horizontal axis of rotation and located adjacent said applicator roll, said rotational axis of said rider located at substantially the same height as said rotational axis of said applicator roll to form a vertical space therebetween for passage of the paper board, wherein said adhesive applying means and said rider are located on opposite sides of said applicator roll and are each linearly movable toward and away from said applicator roll along a horizontal plane extending through the horizontal axis of rotation of said applicator roll.

* * * * *